US006283029B1

(12) United States Patent
Tashiro et al.

(10) Patent No.: US 6,283,029 B1
(45) Date of Patent: Sep. 4, 2001

(54) DIRECT DRAWING TYPE LITHOGRAPHIC PRINTING PLATE PRECURSOR

(75) Inventors: Hiroshi Tashiro; Eiichi Kato, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/464,575

(22) Filed: Dec. 16, 1999

(30) Foreign Application Priority Data

Dec. 17, 1998 (JP) ..... 10-359383

(51) Int. Cl.[7] ..... B41C 1/10

(52) U.S. Cl. ..... 101/455; 101/466; 430/49; 428/446

(58) Field of Search ..... 101/453, 454, 101/455, 457, 462, 460, 463.1, 465, 466; 430/49; 428/148, 446, 447, 689

(56) References Cited

U.S. PATENT DOCUMENTS 5,582,106 * 12/1996 Kanda et al. ..... 101/462
5,607,533 * 3/1997 Kato ..... 101/467
5,677,098 * 10/1997 Nakayama et al. ..... 430/95
5,714,250 * 2/1998 Kato et al. ..... 428/328
5,795,690 * 8/1998 Takegawa et al. ..... 430/58.25
5,852,975 * 12/1998 Miyabe et al. ..... 101/463.1
6,019,045 * 2/2000 Kato et al. ..... 101/466
6,098,545 * 8/2000 Kato ..... 101/465
6,117,552 * 9/2000 Hanada et al. ..... 428/411.1
6,120,655 * 9/2000 Ishii et al. ..... 101/463.1
6,152,037 * 11/2000 Ishii et al. ..... 101/466

FOREIGN PATENT DOCUMENTS

204355 * 8/1998 (JP) .

* cited by examiner

*Primary Examiner*—Stephen R. Funk
(74) *Attorney, Agent, or Firm*—Reed Smith LLP

(57) ABSTRACT

A direct drawing type lithographic printing plate precursor comprising a water-resistant support having provided thereon an image-receiving layer, the image-receiving layer being formed from a dispersion comprising: an inorganic pigment comprising silica particles having an average particle diameter of from 1 to 6 $\mu$m and ultra-fine particles of inorganic pigment having an average particle diameter of from 5 to 50 nm, at a weight ratio thereof of from 40:60 to 70:30; and a hydrophilic binder resin comprising at least one modified hydrophilic binder resin which is modified with a silyl functional group represented by the following formula (I):

$$-Si(R)_n(OX)_{3-n} \quad (I)$$

wherein R represents a hydrogen atom or a hydrocarbon group having from 1 to 12 carbon atoms; X represents an aliphatic group having from 1 to 12 carbon atoms; and n represents 0, 1 or 2. Also disclosed are methods of preparing a lithographic printing plate using the direct drawing type lithographic printing plate precursor.

18 Claims, 2 Drawing Sheets

DIRECT DRAWING TYPE LITHOGRAPHIC PRINTING PLATE PRECURSOR

FIELD OF THE INVENTION

The present invention relates to a direct drawing type lithographic printing plate precursor, and more particularly to a direct drawing type lithographic printing plate precursor suitable for use in the field of small-scale commercial printing.

BACKGROUND OF THE INVENTION

Lithographic printing plate precursors which are presently used in the field of small-scale commercial printing include (1) a direct drawing type printing plate precursor having a hydrophilic image-receiving layer provided on a water-resistant support, (2) a printing plate precursor of an electrophotographic light-sensitive material having a photoconductive layer provided on a water-resistant support, the photoconductive layer comprising photoconductive zinc oxide and is converted into a printing plate by undergoing image formation and then desensitizing treatment with a desensitizing solution to render the non-image area hydrophilic, and (3) a printing plate precursor of a silver-halide photographic material having a silver halide emulsion layer provided on a water-resistant support.

With the development of office appliances and the expansion of office automation in recent years, it has been desired in the field of small-scale printing to adopt an offset printing system wherein a lithographic printing plate is directly prepared from a direct drawing type lithographic printing plate precursor (the foregoing (1)) utilizing various image forming means, e.g., an electrophotographic printer, a heat-sensitive transfer printer or an ink jet printer without undergoing any other special treatment for conversion into the printing plate.

A conventional direct drawing type lithographic printing plate precursor comprises a support such as paper having on one surface side an image-receiving layer which is a surface layer provided via an interlayer and on the other surface side a back layer. The interlayer and the backlayer are each composed of a water-soluble resin such as PVA or starch, a water-dispersible resin such as a synthetic resin emulsion, and a pigment. The image-receiving layer comprises an inorganic pigment, a water-soluble resin and a water resisting agent Examples of inorganic pigment conventionally used include kaolin, clay, talc, calcium carbonate, silica, titanium oxide, zinc oxide, barium sulfate and alumina.

Examples of water-soluble resin used include polyvinyl alcohol (PVA), modified PVA such as carboxylated PVA, starch and derivatives thereof, cellulose derivatives such as carboxymethyl cellulose and hydroxyethyl cellulose, casein, gelatin, polyvinyl pyrrolidone, vinyl acetate-crotonic acid copolymer, and styrene-maleic acid copolymer.

Examples of water resisting agent used include glyoxal, initial condensates of aminoplasts such as melamine-formaldehyde resin and urea-formaldehyde resin, modified polyamide resins such as methylolated polyamide resin, polyamide-polyamine-epichlorohydrin adduct, polyamide epichlorohydrin resin, and modified polyamide-polyimide resin.

In addition to the above described ingredients, it is known that a cross-linking catalyst such as ammonium chloride or a silane coupling agent can also be used.

In recent plate-making system using various kinds of printers, it is required for an image-receiving layer of the printing plate precursor to have both hydrophilicity sufficient for preventing the occurrence of stain due to adhesion of printing ink and water resistance as a lithographic printing plate, and sufficient adhesion to oleophilic images formed thereon. Various proposals have been made in order to satisfy the requirement.

For instance, a proposal has been made to improve the hydrophilicity and image adhesion by the application of an image-receiving layer prepared by dispersing zinc oxide, kaolinite and alumina as inorganic pigments together with a water-soluble resin, a water resisting agent and acetic acid whereby zinc oxide reacts with acetic acid to form zinc acetate, and coating the resulting dispersion as described in JP-A-63-54288 (the term "JP-A" as used herein means an "unexamined published Japanese patent application"). It is also proposed that the hydrophilicity and water resistance are improved by employing the same image-receiving layer described above except that talc or silica is used in place of alumina and an aluminum-based, zirconium-based or titanium-based metal compound is used as the water resisting agent as described in JP-A-63-166590 and JP-A-63-166591.

Also, in case of employing an electrophotographic printer using a dry toner (PPC coping machine) for plate- making, the toner undesirably adheres to non-image area of the resulting printing plate, which forms background stain on prints, when the printing plate is subjected to printing. In order to overcome the problem, a method for controlling surface roughness of the image-receiving layer to a specific range using an organic pigment such as silica having an average diameter of from 5 to 20 Hm as described in JP-B-6-96353 (the term "JP-B" as used herein means an "examined Japanese patent publication") and a method of using as organic pigment, both silica and alumina sol each having an average diameter of from 5 to 20 pm as described in JP-A-62-157058 are proposed.

Further, as an approach for preventing stain occurrences in the non-image area due to the adhesion of ink and increasing adhesion of an ink image to the image-receiving layer during plate-making using a PPC copying machine or a heat-sensitive transfer printer, a method of using colloidal silica having a particle diameter of not more than 20 nm, a pigment such as calcium bicarbonate and a lubricant such as polyethylene wax emulsion in combination as described in JP-A-6-183164, and a method of using synthetic silica powder having a particle diameter of not more than 20 pm, a colloidal silica having a particle diameter of not more than 50 nm and a hydrophilic polyvinyl alcohol resin as described in JP-B-5-17871, are proposed.

On the other hand, the recent spread of various office automated machines, various computers and peripheral appliances thereof and the development of related technology as described above have made it possible to form an image by compilation using a personal computer or a workstation and to output the digital signal of the image directly on a lithographic printing plate precursor from a printer capable of processing digital signal, thereby preparing a printing plate. Also, as a printer capable of processing digital signal which can provide highly accurate images compared with those hitherto known, a laser printer using a dry toner having a particle diameter of from 7 to 8 gm, an ink jet printer of electrostatic ejection type which ejects oil-based ink in the electrostatic field to form an image, and the like have been developed.

However, direct drawing type lithographic printing plate precursors prepared according to conventional techniques are still insufficient with respect to background stains, reproducibility of highly accurate images, durability of image portions (i.e., press life) and the like.

Under these circumstances, it has been desired to provide a direct drawing type lithographic printing plate precursor capable of producing a large number of prints having highly accurate images free from background stains according to the above described system.

SUMMARY OF THE INVENTION

An object of the present invention is to provide a direct drawing type lithographic printing plate precursor capable of preparing a lithographic printing plate which can provide a large number of prints having clear image free from background stain and disappearance or distortion of image.

Another object of the present invention is to provide a direct drawing type lithographic printing plate precursor suitable for plate-making according to an ink jet process of electrostatic ejection type with oil-based ink and capable of preparing a lithographic printing plate which can provide a large number of prints having clear image free from background stain and blur of image.

Other objects and effects of the present invention will become apparent from the following description.

It has been found that the above described objects of the present invention are accomplished by providing the following direct drawing type lithographic printing plate precursors (1) to (4).

(1) A direct drawing type lithographic printing plate precursor comprising a water-resistant support having provided thereon an image-receiving layer, the image-receiving layer being formed from a dispersion comprising:

an inorganic pigment comprising silica particles having an average particle diameter of from 1 to 6 $\mu$m and ultra-fine particles of inorganic pigment having an average particle diameter of from 5 to 50 nm, at a weight ratio thereof of from 40:60 to 70:30; and a hydrophilic binder resin comprising at least one modified hydrophilic binder resin which is modified with a silyl functional group represented by the following formula (I):

$$—Si(R)_n(OX)_{3-n} \quad (I)$$

wherein R represents a hydrogen atom or a hydrocarbon group having from 1 to 12 carbon atoms; X represents an aliphatic group having from 1 to 12 carbon atoms; and n represents 0, 1 or 2.

(2) The direct drawing lithographic printing plate precursor as described in item (1) above, wherein the dispersion further comprises gelatin and a gelatin hardening compound.

(3) The direct drawing lithographic printing plate precursor as described in item (1) or (2) above, wherein the ultra-fine particles of inorganic pigment having an average particle diameter of from 5 to 50 nm comprise at least one member selected from colloidal silica, titania sol and alumina sol.

(4) The direct drawing lithographic printing plate precursor as described in item (2) or (3) above, wherein the gelatin hardening compound is a compound having in its molecule at least two double bond groups represented by the following formula (II):

$$CH_2=CH—W— \quad (II)$$

wherein W represents $—OSO_2—$, $—SO_2—$, $—CONR^1—$ or $—SO_2NR^1—$ (wherein $R^1$ represents a hydrogen atom or an aliphatic group having from 1 to 8 carbon atoms).

BRIEF DESCRIPTION OF THE ACCOMPANYING DRAWINGS

Figure 1:
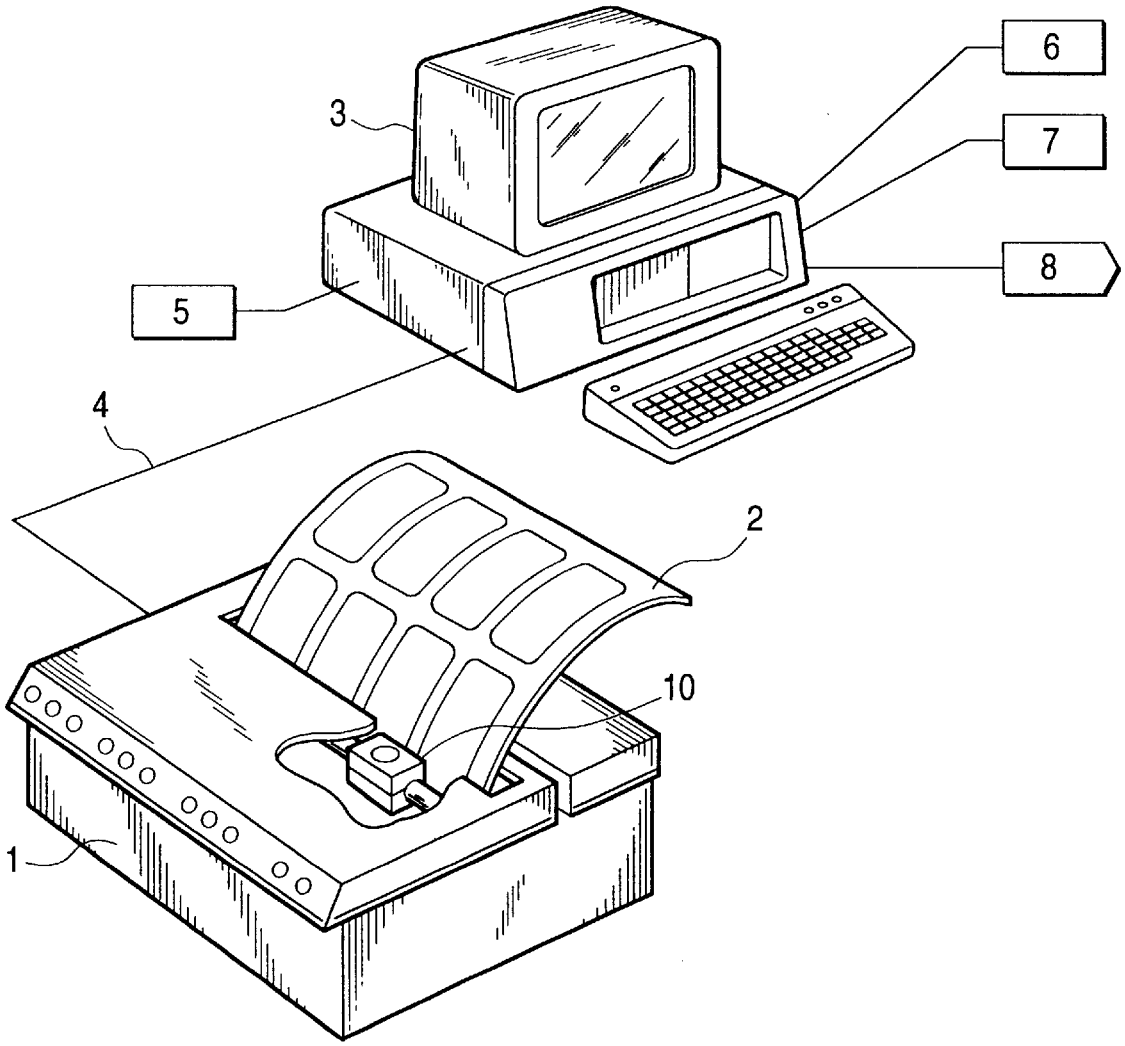
FIG. 1 is a schematic view showing an example of an apparatus system for use in the present invention.

In these figures, the numerals denote the following members respectively:

1: Ink jet recording apparatus

2: Lithographic printing plate precursor (Master)

3: Computer

4: Bus

5: Video camera

6: Hard disk

7: Floppy disk

8: Mouse

10: Head

10*a*: Ejection slit

10*b*: Ejection electrode

10*c*: Counter electrode

11: Oil-based ink

101: Upper unit

102: Lower unit

DETAILED DESCRIPTION OF THE INVENTION

The present invention is described in more detail below.

The image-receiving layer provided on a water- resistant support for use in the present invention is formed from a dispersion containing the specific inorganic pigment and the hydrophilic resin modified with the specific silyl functional group as the main components.

The inorganic pigment comprises silica particles having an average particle diameter of from 1 to 6 $\mu$m and ultra-fine particles of inorganic pigment having an average particle diameter of from 5 to 50 nm.

The silica particles to be used in the present invention preferably have an average particle diameter of from 1.0 to 4.5 $\mu$m. The silica particles are finely divided amorphous synthetic silica powder comprising silicon dioxide as a main component (not less than 99%) and having no crystalline structure. Such silica particles are specifically described, for example, in Toshiro Kagami and Akira Hayashi supervised, *Kojundo Sirika no Ouyougijitsu* (*Applied Technique of High Purity Silica*), Chapters 4 and 5, CMC (1991).

The finely divided synthetic silica powder of the present invention has a well-controlled porosity and pore volume and an average particle diameter of from 1 to 6 Wm. However, the pore diameter, pore volume, oil absorption amount, surface silanol group density, etc. of the finely divided synthetic silica powder for use in the present invention are not specifically limited. The finely divided synthetic silica powder is easily available as commercial products.

As the ultra-fine particles of inorganic pigment having an average particle diameter of from 5 to 50 nm there may be used conventionally known compounds. Preferred examples of such compounds include silica sol, titania sol, alumina sol, titanium oxide, titanium oxide hydrate, magnesium oxide, magnesium carbonate, zinc oxide, nickel oxide, and zirconium oxide. More preferred examples include silica sol, titania sol, alumina sol and combinations of two or more of these compounds.

Silica sol is a dispersion in which ultra-fine silica particles having a particle diameter of from 1 to 100 nm and having many hydroxyl groups on the surface thereof and forming siloxane bond (—Si—O—Si—) in the inside thereof are dispersed in water or a polar solvent. The silica sol is also referred to as "colloidal silica". The silica sol is specifically described in the above described *Kolundo Sirika no Ouyougijitsu* (*Applied Technique of High Purity Silica*).

Alumina sol is an alumina hydrate (boehmite-based compound) having a colloidal size of from 5 to 200 nm dispersed in water, in which an anion (e.g., a halogen ion such as fluorine ion or chlorine ion, or a carboxylic anion such as acetic ion) functions as a stabilizer.

Titania sol means and includes $TiO_2$ and $Ti(O)(OH)_2$ each having a colloidal size of from 5 to 500 nm and a mixture thereof.

Among the colloidal fine particles described above, those having an average particle diameter of from 5 to 50 nm, preferably from 5 to 40 nm can be used in the present invention. The ultra-fine particles of inorganic pigment are easily available as commercial products.

The weight ratio of the silica particles and the ultra-fine particles of inorganic pigment is from 40:60 to 70:30, preferably from 45:55 to 60:40.

By controlling each particle diameter of the silica particles and the ultra-fine particles of inorganic pigment for use in the present invention and the weight ratio thereof in the above described range, the resulting image-receiving layer maintains a sufficient film strength, and when the printing plate precursor obtained is subjected to plate-making using various printers, the occurrence of stain due to adhesion of toner or ink to the non-image area is suppressed on a practically acceptable level and highly accurate images such as fine lines, fine letters or small dots are clear without disappearance, distortion and blur. Further, when the printing plate is subjected to printing, the non-image area has excellent hydrophilicity and is prevented from adhesion of printing ink, and on the other hand, in the image area, toner or ink firmly adheres to the image-receiving layer and thus, an excellent result that disappearance of image does not occur after a large number of sheets are printed can be obtained.

The hydrophilic binder resin for use in the present invention includes a hydrophilic resin modified with an silyl functional group represented by the formula (I) described above.

In formula (I), the hydrocarbon group represented by R preferably includes an alkyl group having from 1 to 12 carbon atoms which may be substituted (for example, methyl, ethyl, propyl, butyl, pentyl, hexyl, heptyl, octyl, nonyl, decyl, dodecyl, 2-hydroxyethyl, 2-methoxyethyl, 2-cyanoethyl, 2-ethoxyethyl, 3,6-dioxoheptyl, 3-sulfopropyl, 2-carboxyethyl, 2-methoxycarbonylethyl, 3-chloropropyl, 3bromopropyl, 2,3-dihydroxypropyl or trifluoroethyl), an alkenyl group having from 3 to 12 carbon atoms which may be substituted (for example, propenyl, butenyl, pentenyl, hexenyl, heptenyl, octenyl, nonenyl or decenyl), an aralkyl group having from 7 to 12 carbon atoms which may be substituted (for example, benzyl, phenethyl, 3-phenylpropyl, chlorobenzyl, bromobenzyl, methylbenzyl, ethylbenzyl, methoxybenzyl, dimethylbenzyl, dimethoxybenzyl or carboxybenzyl), an alcyclic group having from 5 to 8 carbon atoms which may be substituted (for example, cyclopentyl, cyclohexyl, 2-cyclohexylethyl or 2-cyclopentylethyl), and an aromatic group having from 6 to 12 carbon atoms which may be substituted (for example, phenyl, naphthyl, tolyl, xylyl, propylphenyl, butylphenyl, octylphenyl, dodecyl-phenyl, methoxyphenyl, ethoxyphenyl, butoxyphenyl, decyloxyphenyl, chlorophenyl, dichrolophenyl, bromophenyl, cyanophenyl, acetylphenyl, methoxycarbonylphenyl, ethoxycarbonylphenyl, butoxycarbonylphenyl, acetamidophenyl, propionamidophenyl, carboxyphenyl, sulfophenyl and carboxy-methylphenyl).

In formula (I), X represents an aliphatic group having from 1 to 12 carbon atoms. Preferred examples of the aliphatic group include an alkyl group having from 1 to 8 carbon atoms which may be substituted (for example, methyl, ethyl, propyl, butyl, pentyl, hexyl, heptyl, octyl, 2-methoxyethyl, 2-ethoxyethyl, 3-methoxypropyl, 3,6-dioxoheptyl or 2-oxobutyl), an alkenyl group having from 3 to 8 carbon atoms which may be substituted (for example, propenyl, butenyl, pentenyl, hexenyl, heptenyl or octenyl), an aralkyl group having from 7 to 12 carbon atoms which may be substituted (for example, benzyl, phenethyl, 3-phenylpropyl, chlorobenzyl, bromobenzyl, methylbenzyl, ethylbenzyl, methoxybenzyl, dimethylbenzyl or dimethoxybenzyl) and an alcyclic group having from 5 to 8 carbon atoms which may be substituted (for example, cyclopentyl, cyclohexyl, cycloheptyl or cycloctyl). More preferred aliphatic group for X is an alkyl group having from 1 to 4 carbon atoms which may be substituted.

In formula (I), n represents 0, 1 or 2, and preferably 0 or 1.

The hydrophilic resin containing a silyl functional group represented by formula (I) according to the present invention can be easily prepared according to conventionally known methods, for example, those described, in *Hannousei Porima no Gousei to Ouyou* (*Synthesis and Application of Reactive Polymers*) CMC (1989), JP-B-46-30711 and JP-A-5-32931. Specifically, the resin is prepared by modifying a hydroxy group of a hydroxy group-containing hydrophilic resin with a silylating agent.

The hydroxy group-containing resin suitable for the preparation of the hydrophilic resin containing the silyl functional group may be any of natural water-soluble polymers, semisynthetic water-soluble polymers and synthetic water-soluble polymers, and include those described, for example, in Keiei Kaihatsu Center Publishing Division ed., *Suiyousei Koubunshi•Mizubunsangata Jushi Sougogijutu* (*Water-Soluble Polymers•Aqueous Dispersion Type Resins: Collective Technical Data*), Keiei Kaihatsu Center Publishing Division (1981), Sinji Nagatomo, *Shin-Suiyousei Porima no Ouyou to Shijo* (*New Applications and Market of Water-Soluble Polymers*), CMC (1988), *Kinousei Serurosu no Kaihatsu* (*Development of Functional Cellulose*), CMC (1985), and Munio Kotake supervised, *Daiyuukikagaku* (*Grand Organic Chemistry*), *Vol.* 19, *Tennen Koubunshi Kagoubutsu* (*Natural Polymer Compounds*) *I*, Asakura Shoten (1960).

Specific examples of the natural and semisynthetic water-soluble polymers include cellulose, cellulose derivatives (e.g., cellulose esters such as cellulose nitrate, cellulose sulfate, cellulose acetate, cellulose propionate, cellulose succinate, cellulose butyrate, cellulose acetate succinate, cellulose acetate butyrate or cellulose acetate phthalate; and cellulose ethers such as methylcellulose, ethylcellulose, cyanoethylcellulose, carboxymethylcellulose, hydroxyethylcellulose, hydroxy-propylcellulose, ethyl hydroxyethylcellulose, hydroxypropyl methylcellulose or carboxymethyl hydroxyethylcellulose), starch, starch derivatives (e.g., oxidized starch, esterified starch including those esterified with an acid such as nitric acid, sulfuric acid, phosphoric acid, acetic acid, propionic acid, butyric acid or succinic acid; and etherified starch such as methylated starch, ethylated starch, cyanoethylated starch, hydroxyalkylated starch or carboxymethylated starch), alginic acid, pectin, carrageenan, tamarind gum, natural rubber (e.g., gum arabic, guar gum, locust bean gum, tragacanth gum or xanthane gum), pullulan, dextran, casein, gelatin, chitin and chitosan.

Specific examples of the synthetic water-soluble polymer include polyvinyl alcohol, polyalkylene glycols (e.g., polyethylene glycol, polypropylene glycol or ethylene glycol/propylene glycol copolymers), allyl alcohol copolymers, acrylate copolymers, methacrylate copolymers, homopolymers or copolymers of acrylate or methacrylate containing at least one hydroxy group (examples of ester portion including a 2-hydroxyethyl, 3-hydroxypropyl, 2,3-dihydroxypropyl, 3-hydroxy-2-hydroxymethyl-2-methylpropyl, 3-hydroxy-2,2-di(hydroxymethyl)propyl, polyoxyethylene and polyoxypropylene group), homopolymers or copolymers of N-substituted acrylamide or methacrylamide containing at least one hydroxy group (examples of N-substituent including a monomethylol, 2-hydroxyethyl, 3-hydroxypropyl, 1,1-bis(hydroxymethyl)ethyl and 2,3,4,5,6-penta-hydroxypentyl group). However, the synthetic water-soluble polymer is not particularly limited as far as it contains at least one hydroxy group in the side chain substituent of the repeating unit thereof.

The weight average molecular weight of these hydrophilic resins for use in the present invention is preferably from $1\times10^3$ to $1\times10^6$, more preferably from $5\times10^3$ to $4\times10^5$.

The content of the silyl functional group in the modified hydrophilic resin according to the present invention is not particularly limited. However, it is suitably from 0.01 to 50% by mole, preferably from 0.1 to 20% by mole, and more preferably from 0.2 to 15% by mole, in terms of a component repeating unit which contains the silyl functional group. When the hydrophilic resin is a saccharide or a protein, the component repeating unit means a monosaccharide and an amino acid, which constitute the saccharide or protein, respectively.

The silyl functional group may be connected to a side chain of repeating units of the polymer or a terminal of the polymer main chain, directly or through a linking group. The linking group includes any linking group, for example, —O—, —$CR^{11}R^{12}$— (wherein $R^{11}$ and $R^{12}$, which may be the same or different, each represents a hydrogen atom, a halogen atom (e.g., fluorine, chlorine or bromine), a hydroxy group, a cyano group, an alkyl group (e.g., methyl, ethyl, 2-chloroethyl, 2-hydroxyethyl, propyl or butyl), an aralkyl group (e.g., benzyl or phenethyl), or a phenyl group), —S—, —$NR^{13}$— (wherein $R^{13}$ represents a hydrogen atom or a hydrocarbon group including specifically one having from 1 to 8 carbon atoms (e.g., methyl, ethyl, propyl, butyl, hexyl, 2-methoxyethyl, 2-chloroethyl, 2-cyanoethyl, benzyl methylbenzyl, phenetyl, phenyl, tolyl, chlorophenyl or methoxyphenyl), —CO—, —COO—, —OCO—, —$CONR^{13}$—, —$SO_2NR^{13}$—, —$SO_2$—, —NHCONH—, —NHCOO—, —$NHSO_2$—, —CONHCOO— and —CONHCONH—, individually or in combination of two or more thereof.

The hydrophilic resin containing the silyl functional group represented by formula (I) according to the present invention can be employed individually or as a mixture of two or more thereof.

The hydrophilic resin easily forms a siloxane bond represented by formula (Ia) shown below upon a condensation reaction of the groups of —$Si(R)_n(Ox)_{3-n}$ during a drying step of a coating containing the hydrophilic resin with heating to cause crosslinkage between the resins.

(Ia)

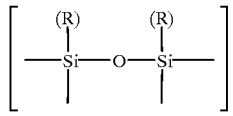

Thus, the image-receiving layer is hardened to maintain a sufficient film strength. The surface of the image-receiving layer according to the present invention is sufficiently hydrophilic and at the same time, adhesion of the image thereto is extremely good and thus press life of a printing plate prepared is greatly improved, although the reason therefor is unknown in detail.

It is preferred that the image-receiving layer according to the present invention further contains gelatin and a gelatin hardening compound as hydrophilic binder resins. In such a case, the image-receiving layer is formed by applying a dispersion containing gelatin and a gelatin hardening compound together with the above described components.

By using gelatin as an additional hydrophilic binder resin for the image-receiving layer according to the present invention, dispersion of the mixture for the image-receiving layer is easily conducted, uniform dispersion of the inorganic pigment is more promoted. As a result, the film strength of the image-receiving layer is improved, smoothness of the surface of the image-receiving layer is controlled in a finely uneven state, and both the adhesion of image in the image area and hydrophilicity in the non-image area are more improved.

The gelatin for use in the present invention is one of derived proteins and is not specifically limited so far as it is produced from collagen. The gelatin is preferably light-colored, transparent, tasteless and odorless. Further, gelatin for a photographic emulsion is more desirable because it exhibits physical properties (such as viscosity of the resulting aqueous solution and jelly strength of gel) falling within predetermined ranges.

By using a gelatin compound as an additional hydrophilic binder resin in the image-receiving layer according to the present invention, it hardens itself and hence exhibits good water resistance.

As the gelatin hardening compound, a conventionally known compound can be employed. Examples of the gelatin hardening compound are described, for example, in T. H. James, *The Theory of the Photographic Process*, Chapter 2, Section III, Macmillan Publishing Co., Inc. (1977) and *Research Disclosure*, No. 17643, page 26 (December, 1970).

Preferred examples of the gelatin hardening compound include dialdehydes such as succinaldehyde, glutaraldehyde and adipaldehyde, diketones such as 2,3-butanedione, 2,5-hexanedione, 3-hexane-2,4-dione and 1,2-cyclopentanedione, and active olefin compounds having two or more double bonds and electron attractive groups bonded adjacent to the double bonds per molecule.

More preferably, the gelatin hardening compound is a compound having in its molecule at least two double bond groups represented by formula (II) described above.

In formula (II), $R^1$ preferably represents a hydrogen atom or an alkyl group having from 1 to 6 carbon atoms which may be substituted (for example, methyl ethyl, propyl butyl, methylol, 2-chloroethyl, 2-hydroxyethyl, 2-carboxyethyl or 3-methoxypropyl). In formula (II), W preferably represents —$SO_2$—.

Specific examples of the gelatin hardening compound include resolcinolbis(vinylsulfonate), 4,6-bis(vinylsulfonyl)-m-xylene, bis(vinylsulfonylalkyl)ether, bis(vinylsulfonylalkyl)amine, 1,3,5-tris(vinylsulfonyl)-hexahydro-s-triazine, 1,3,5-triacryloylhexahydro-s-triazine, diacrylamide, 1,3-bis(acryloyl)urea and N,N'-bismaleimide.

The gelatin hardening compound is preferably used in an amount of from 0.5 to 20 parts by weight, more preferably from 0.8 to 10 parts by weight, based on 100 parts by weight of gelatin. In the range described above, the resulting image-receiving layer maintains the sufficient film strength and exhibits the excellent water resistance without damaging its hydrophilicity.

In the image-receiving layer according to the present invention, the weight ratio of the inorganic pigment to the hydrophilic binder resin used is preferably from 85:15 to 50:50, more preferably from 85:15 to 60:40. Within such a range, the effects of the present invention such as the film strength, prevention from adhesion of printing ink in the non-image area and adhesion of image in the image area (press life of printing plate) are markedly obtained.

The image-receiving layer according to the present invention may contain other components in addition to the above described components.

One example of other components is an inorganic pigment other than the silica particles and ultra-fine inorganic pigment particles according to the present invention. Suitable examples of other inorganic pigment include kaolin, clay, calcium carbonate, barium carbonate, calcium sulfate, barium sulfate, magnesium carbonate, and metal oxides such as magnesium oxide, titanium oxide, zirconium oxide and zinc oxide. When other inorganic pigment is additionally employed, it can be used in an amount of not more than 20% by weight based on the silica particles used according to the present invention.

The image-receiving layer according to the present invention may contain various additives such as a surface active agent for improving a coating property of a coating composition of the image-receiving layer (surface controlling agent), a defoaming agent and a buffer for adjusting pH of the layer.

The thickness of the image-receiving layer according to the present invention is preferably from about 3 to 30 g calculated in terms of the coating amount (dry basis) of the image-receiving layer composition per $m^2$.

The surface smoothness of the image-receiving layer according to the present invention is preferably not less than 30 (sec/10 ml) in terms of Bekk smoothness. Depending on a printer, for example, a heat-sensitive printer, an ink jet printer or an electrophotographic printer employed for plate-making, a preferred range of the surface smoothness may be varied. Also, the preferred range may be varied depending on a toner used, for example, a dry toner or a liquid toner.

In case of using an electrophotographic printer or heat-sensitive printer with a dry toner, the surface smoothness of the image-receiving layer of the printing plate precursor according to the present invention is preferably from 30 to 200 (sec/10 ml), more preferably from 50 to 150 (sec/lO ml), in terms of Bekk smoothness. In such a range, adhesion of scattered toner to the non-image area (which causes background stain) is prevented and adhesion of toner to the image-receiving layer in the image area is uniformly and sufficiently conducted during steps of transfer and fixing of toner image on the printing plate precursor, and as a result, reproducibility of fine lines and fine letters and uniformity of solid image portion are more improved.

On the other hand, in case of using an electro- photographic printer, heat-sensitive printer or ink jet printer with a liquid toner, the surface smoothness of the image-receiving layer according to the present invention is preferably from 100 to 3000 (sec/10 ml), more preferably from 120 to 2500 (sec/10 ml), in terms of Bekk smoothness. In such a range, highly accurate images such as fine lines, fine letters and dot images are faithfully formed on the image-receiving layer and the image area adheres sufficiently firmly to the image-receiving layer to maintain image strength. Further, due to the finely uneven state of the surface of the image-receiving layer in the non-image area, dampening water is apt to be kept on the surface, and thus the occurrence of printing stain can be prevented.

In the present invention, the Bekk smoothness can be measured by a Bekk smoothness tester. The Bekk smoothness tester is a tester for measuring a time required for a definite amount (10 ml) of air to pass through between a test piece and a glass surface under a reduced pressure, wherein the test piece is pressed to a highly smoothly finished circular glass plate having a hole at its center at a definite pressure (1 kg/$cm^2$).

It is more preferred that the surface of the image-receiving layer has high protrusions densely. More specifically, the image-receiving layer preferably has an average surface center roughness (SRa) defined by ISO-468 in the range of from 1.3 to 3.5 $\mu$m. and an average wavelength (Sea), which indicates the density of the surface roughness, of not more than 50 $\mu$m. More preferably, the SRa is in the range of from 1.35 to 2.5 $\mu$m, and the S$\lambda$a is not more than 45 $\mu$m. It is believed that the adhesion of scattered toner to the non-image area after plate-making by electrophotography and spreading of adhered toner during fixing can be prevented owing to the use of the image-receiving layer having the above described surface unevenness.

The image-receiving layer according to the present invention is provided on a water-resistant support in a conventional manner. Suitable water-resistant support includes paper subjected to water-resistant treatment, paper laminated with a plastic film or a metal foil and a plastic film.

The water-resistant support preferably has a highly smooth surface. Specifically, it is desirable that the surface of the support which is in contact with the image-receiving layer have a Bekk smoothness adjusted to preferably at least 300 (sec/10 ml), more preferably from 900 to 3,000 (sec/10 ml), and still more preferably from 1,000 to 3,000 (sec/10 ml). By adjusting the Bekk smoothness of the surface of the support which contacts the image-receiving layer to at least 300 (sec/10 ml), the image reproducibility and press life can be further improved. As such improving effects can be obtained even when the image-receiving layer having the same surface smoothness is used, the increase in the smoothness of the support surface is considered to increase the adhesion between the image area and the image-receiving layer.

The Bekk smoothness of the surface of the support can be measured in the same manner as described with respect to the image-receiving layer.

The expression "highly smooth surface of the water-resistant support" as used herein means a surface coated directly with the image-receiving layer. In other words, when the support has a conductive layer, an under layer or an overcoat layer, the highly smooth surface denotes the surface of the conductive layer, under layer or overcoat layer.

Thus, the image-receiving layer having the surface condition controlled as described above can be well maintained without receiving the influence of surface roughness of the support used. As a result, it becomes possible to further improve the image quality.

The adjustment of the surface smoothness to the above described range can be made using various well-known methods. The Bekk smoothness of the support surface can be adjusted to the above described range, for example, by coating a surface of the substrate with a resin using a melt adhesion method or by using a strengthened calender method utilizing highly smooth heated rollers.

The direct drawing type lithographic printing plate precursor of the present invention is preferably employed as a lithographic printing plate precursor for forming a toner image by an electrophotographic recording system or for forming an ink image by an ink jet process of electrostatic ejection type in which an oil-based ink is ejected by utilizing electrostatic attraction on the image-receiving layer thereof. The printing plate obtained can provide a large number of prints having clear images.

Usually in the electrophotographic recording system, image formation is conducted by an electrophotographic process and transfer of toner image to a receiving material is carried out electrostatically.

Therefore, the water-resistant support of the printing plate precursor is preferably electrically conductive. Specifically, the volume specific electric resistance of the support is preferably from $10^4$ to $10^{13}$ Ω·cm, more preferably from $10^7$ to $10^{12}$ Ω·cm.

By adjusting the volume specific electric resistance to the above described range, blur and distortion in the transferred image area and stain due to adhesion of toner to the non-image area can be prevented to a practically negligible extent, so that the images of good quality can be obtained.

It is also desirable for the water-resistant support to have electric conductivity, when the image formation is conducted by the ink jet recording system of electrostatic ejection type. At least in the part just under the image-receiving layer, the support has the specific electric resistance of preferably not more than $10^{10}$ Ω·cm. For the water-resistant support as a whole, the specific electric resistance is preferably $10^{10}$ Ω·cm or below, and more preferably $_{10}{}^{8}$ Ω·cm or below. The value may be infinitely close to zero.

The electric conductivity as described above can be conferred on the support in the part just under the image-receiving layer, e.g., by covering a substrate such as paper or film, with a layer comprising an electrically conductive filler such as carbon black, and a binder, by sticking a metal foil on a substrate, or by vapor-evaporating a metal onto a substrate. On the other hand, examples of the support that is electrically conductive as the whole include electrically conductive paper impregnated with sodium chloride, a plastic film into which an electrically conductive filler such as carbon black is incorporated, and a metal plate such as an aluminum plate.

In the above described range of electric conductivity, the charged ink droplets just after attaching to the image-receiving layer can quickly lose their electric charge through earth. Thus, clear images free from disorder can be formed.

The specific electric resistance (also referred to as volume specific electric resistance or specific resistivity, sometimes) is measured by a three-terminal method with a guard electrode according to the method described in JIS K-6911.

Now, the water-resistant support having conductivity which can be preferably used in the present invention is described in more detail below.

The support which is conductive as the whole can be prepared by using as a substrate a conductive base paper, such as paper impregnated with sodium chloride, and providing a conductive water-resistant layer on both sides of the substrate.

Examples of paper which can be used for preparing the conductive base paper include wood pulp paper, synthetic pulp paper, and paper made from a mixture of wood pulp and synthetic pulp. It is preferred for such paper to have a thickness of 80 to 200 μm.

The conductive layer is described below.

The formation of the conductive layer can be performed by applying a layer containing a conductive filler and a binder on the both sides of the conductive paper. The thickness of each of the conductive layer applied is preferably from 5 to 20 μm.

Examples of the conductive filler usable include granular carbon black or graphite, metal powder such as silver, copper, nickel, brass, aluminum, steel or stainless steel powder, tin oxide powder, flaky aluminum or nickel, and fibrous carbon.

The binder can be appropriately selected from various kinds of resins. Examples of a resin suitable for the binder include hydrophobic resins, for example, acrylic resins, vinyl chloride resins, styrene resins, styrene- butadiene resins, styrene-acrylic resins, urethane resins, vinylidene chloride resins and vinyl acetate resins, and hydrophilic resins, for example, polyvinyl alcohol resins, cellulose derivatives, starch and derivatives thereof, polyacrylamide resins and copolymers of styrene and maleic anhydride.

Another method for forming the conductive layer is to laminate a conductive thin film. Examples of the conductive thin film usable include a metal foil and a conductive plastic film. More specifically, an aluminum foil can be used for the metal foil, and a polyethylene resin film in which carbon black is incorporated can be used for the conductive plastic film. Both hard and soft aluminum foils can be used as the laminating material. The thickness of the conductive thin films is preferably from 5 to 20 μm.

For the lamination of a polyethylene resin in which carbon black is incorporated, it is preferred to adopt an extrusion lamination method. The extrusion lamination method includes the steps of melting a polyethylene resin by heating, forming the molten resin into a film, pressing the film immediately against base paper and then cooling them, and can be carried out with various well-known apparatuses. The thickness of the laminated layer is preferably from 10 to 30 μm.

As the support having conductivity as a whole, a conductive plastic film and a metal plate can be used as they are as far as they have a satisfactory water-resistant property.

The conductive plastic film includes, e.g., a polypropylene or polyester film in which a conductive filler such as carbon fiber or carbon black is incorporated, and the metal plate includes, e.g., an aluminum plate. The thickness of a substrate is preferably from 80 to 200 μm. When the substrate has a thickness of less than 80 μm, it may not ensure sufficient strength for a printing plate. On the other hand, when the thickness of the substrate is more than 200 μm, the handling-property such as transportability in a recording apparatus may tend to decrease.

As the water-resistant substrate on which the conductive layer is provided, paper subjected to water-resistant treatment, paper laminated with a plastic film or a metal foil and a plastic film each preferably having a thickness of from 80 to 200 μm can be used.

As a method for forming a conductive layer on the substrate, the same methods as described in the case where the whole of the support is conductive, can be used. More specifically, the composition containing a conductive filler and a binder is applied to one side of the substrate to form a layer having a thickness of from 5 to 20 μm. Also, the conductive layer is formed by laminating a metal foil or a conductive plastic film on the substrate.

Another method which may be employed comprises depositing a metal film such as an aluminum, tin, palladium or gold film onto a plastic film.

Thus, the water-resistant support having the electrically conductive property can be obtained.

For preventing the printing plate precursor from curling, the support used in the present invention may have a backcoat layer (backing layer) on the side opposite to the image-receiving layer. It is preferred that the backcoat layer has the Bekk smoothness of from 150 to 700 (sec/10 ml).

By providing such a backcoat layer on the support, the printing plate obtained can be mounted exactly in an offset printing machine without suffering shear or slippage.

The thickness of the water-resistant support provided with the under layer or the backcoat layer is from 90 to 130 μm, more preferably from 100 to 120 μm.

Image formation on the lithographic printing plate precursor can be performed by any appropriate method, for example, a heat-sensitive transfer recording system, an electrophotographic recording system or an ink jet recording system to perform plate-making.

Any of conventionally known electrophotographic recording systems can be employed for the image formation. For instance, the recording systems described, e.g., in Denshishashin Gakkai ed., *Denshishashin Gijutsu no Kiso to Ouyo* (*The Fundamentals and Applications of Electrophotographic Techniques*, Corona Co. (1988), Kenichi Eda, *Denshishasin Gakkaishi* (*Journal of Electrophotoaraphic Society*), 27, 113 (1988), and Akio Kawamoto, ibid., 33, 149 (1994) and 32, 196 (1993); and commercially available PPC duplicating machines can be employed.

A combination of an exposure system in which the exposure is performed by scanning the laser beams based on digital information with a development system using a liquid developer can be adopted as an effective method for image formation, because it enables the formation of highly accurate images. One example utilizing such a combination is illustrated below.

A photosensitive material is positioned on a flat bed by a register pin system, and fixed to the flat bed by undergoing air suction from the back side. Then, the photosensitive material is charged by means of a charging device described, e.g., in the above-described reference, *The Fundamentals and Applications of Electrophotographic Techniques*, p. 212 et seq. Specifically, a corotron or scotron system is ordinarily used for charging. At the time of charging, it is also preferred to control the charging condition so that the surface potential of the photosensitive material is always kept within the intended range through a feedback system based on the information from a means of detecting the potential of the charged photosensitive material. Thereafter, the scanning exposure using a laser-beam source is performed according to, e.g., the method as described in the reference described above, p. 254 et seq.

Then, toner image formation is carried out with a liquid developer. The photosensitive material charged and exposed on the flat bed is detached from the flat bed, and subjected to wet development as described in the reference described above, p. 275 et seq. The exposure is carried out in a mode corresponding to the toner image development mode. In the case of reversal development, for instance, a negative image, or an image area, is exposed to laser beams, a toner having the same charge polarity as the charged photosensitive material is employed, and the toner is adhered electrically to the exposed area by applying a bias voltage for development. The principle of this process is explained in detail in the reference described above, p. 157 et seq.

For removal of excess developer after the development, the photosensitive material is squeegeed with a rubber roller, a gap roller or a reverse roller, or subjected to corona squeegee or air squeegee as described at page 283 of the above-described reference. Before such a squeegee treatment, the photosensitive material is preferably rinsed with only a carrier liquid of the liquid developer.

Then, the toner image formed on the photosensitive material is transferred onto the lithographic printing plate precursor according to the present invention directly or via a transfer intermediate, and fixed to the printing plate precursor.

Any of conventionally known ink jet recording systems can be employed for the image formation. However, the use of oil-based ink is desirable because it ensures quick drying and satisfactory fixation of the ink image and hardly clogs a nozzle and a filter, and the adoption of an electrostatic ejection type ink jet recording system, or a solid jet type ink jet recording system with hot-melt ink is preferably used because such a system hardly causes blur of image.

For the electrostatic ejection type ink jet recording system, recording apparatus described in WO 93/11866, WO 97/27058 and WO 97/27060 can be employed. The oil-based ink to be used is preferably a dispersion comprising hydrophobic resin particles, which are solid at least at normal temperature (i.e., 15 to 35° C.), dispersed in a nonaquea us solvent having an electric resistance of $10^9$ Ω·cm or more and a dielectric constant of 3.5 or below as a dispersion medium. By using such a nonaqueous solvent as the dispersion medium, the electric resistance of the oil-based ink is appropriately controlled and thus, the ejection of the oil-based ink by the action of an electric field can be properly carried out, whereby image quality obtained is improved. Further, the use of the resin particles described above can enhance affinity for the image-receiving layer and as a result, images of good quality are obtained as well as press life of the resulting printing plate is increased.

Specific examples of the oil-based ink are described, for example, in U.S. Pat. Nos. 6,143,806, 6,174,936, 6,184,267 and 6,127,452, U.S. patent application Ser. No. 09/009,131, JP-A-10-204354 and JP-A-10-306244.

For the solid jet type ink jet recording system, commercially available printing systems such as Solid Inkjet Platemaker SJ02A (manufactured by Hitachi Koki Co., Ltd.) and MP-120OPro (manufactured by Dynic Co., Ltd.) are employed.

A method for forming image on the lithographic printing plate precursor according to the present invention using an ink jet recording system is described in more detail with reference to FIG. 1 to FIG. 3 below.

A device system shown in FIG. 1 comprises an ink jet recording device 1 wherein an oil-based ink is used.

As shown in FIG. 1, pattern information of images (figures and letters) to be formed on a lithographic printing plate precursor (also referred to as "master" hereinafter) 2 is first supplied from an information supply source such as a computer 3 to the ink jet recording device 1 using oil-based ink through a transmission means such as a bus 4. A head for ink jet recording 10 of the recording device 1 stores oil-based ink inside. When the master 2 is passed through the recording device 1, the head 10 ejects fine droplets of the ink onto the master 2 in accordance with the foregoing information, whereby the ink is attached to the master 2 in the foregoing pattern. Thus, the image formation on the master 2 is completed and a lithographic printing plate is obtained.

Figure 2:
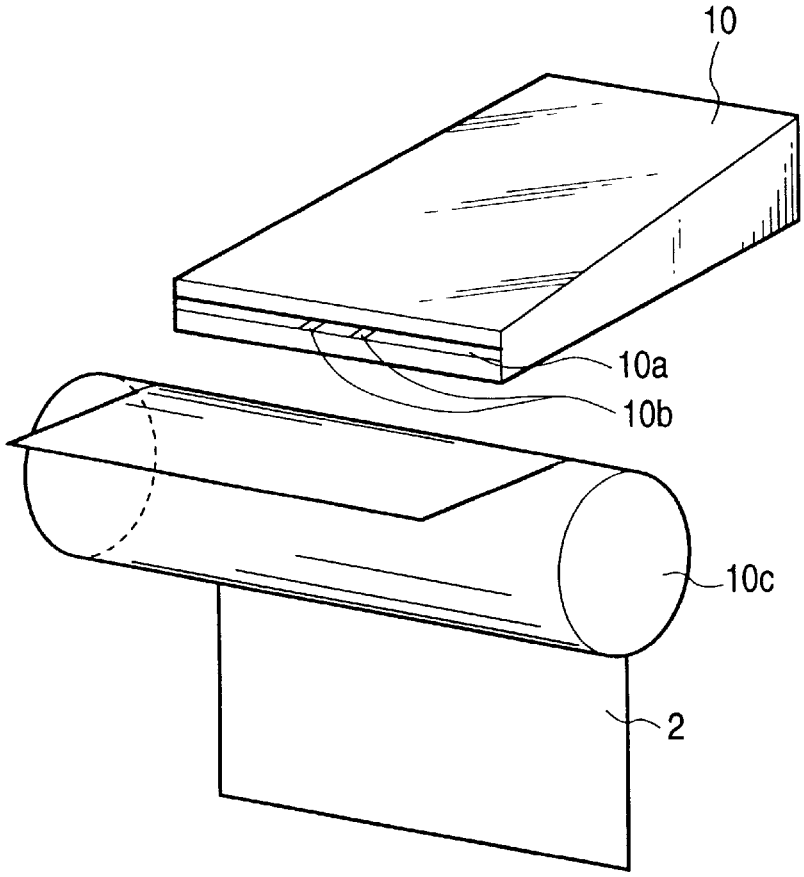
FIG. 2 is a schematic view showing the main part of an ink jet recording device for use in the present invention.
Figure 3:
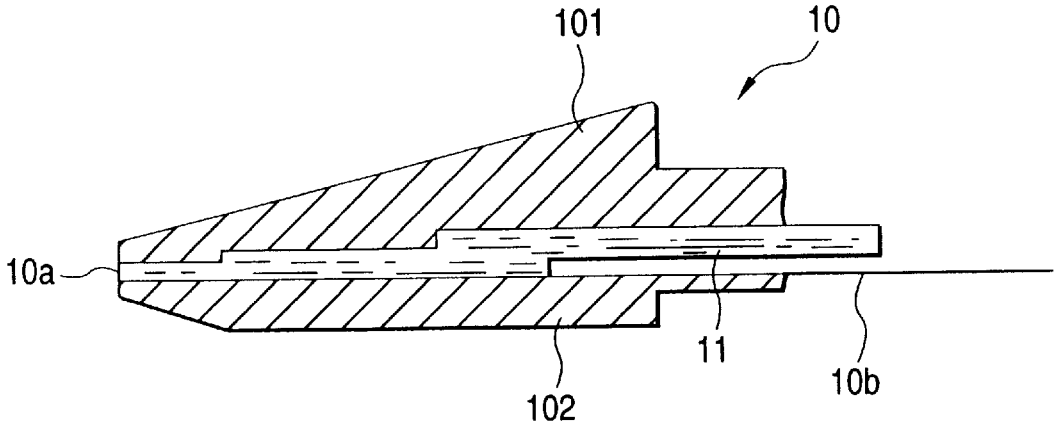
FIG. 3 is a partially cross sectional view of a head of an ink jet recording device for use in the present invention.

Components of the ink jet recording device as shown in the device system of FIG. 1 are shown in FIG. 2 and FIG. 3, respectively. In FIG. 2 and FIG. 3, members common to the members in FIG. 1 are designated using the same symbols, respectively.

FIG. 2 is a schematic view showing the main part of the ink jet recording device, and FIG. 3 is a partially cross sectional view of the head.

As shown in FIG. 3, the head 10 attached to the ink jet recording device has a slit between an upper unit 101 and a lower unit 102, a leading edge thereof forms an ejection slit 10*a*. Further, an ejection electrode 10*b* is arranged in the slit, and the interior of the slit is filled with oil-based ink 11.

To the ejection electrode 10*b* of the head 10, voltage is applied in accordance with digital signals from the pattern information of image. As shown in FIG. 2, a counter electrode 10*c* is arranged so as to face with the ejection electrode 10*b*, and the master 2 is provided on the counter electrode 10*c*. By the application of the voltage, a circuit is formed between the ejection electrode 10*b* and the counter electrode 10*c*, and the oil-based ink 11 is ejected from the ejection slit 10*a* of the head 10, thereby forming images on the master 2 provided on the counter electrode 10*c*.

With respect to the width of the ejection electrode 10*b*, it is preferred for the leading edge thereof to be as narrow as possible in order to form images of high quality.

For instance, print of 40 $\mu$m-dot can be formed on the master 2 by filling the head 10 as shown in FIG. 3 with the oil-based ink, disposing the ejection electrode 10*b* having a leading edge having a width of 20 $\mu$m and the counter electrode 10*c* so as to face with each other at a distance of 1.5 mm and applying a voltage of 3 kV for 0.1 millisecond between these two electrodes.

The master after plate-making obtained by image formation by the ink jet system using oil-based ink on the lithographic printing plate as described above is used as a printing plate.

According to the present invention, a direct drawing type lithographic printing plate precursor capable of preparing a lithographic printing plate which provides a large number of prints having clear image free from background stain and disappearance or distortion of image. Also, a direct drawing type lithographic printing plate precursor suitable for plate-making according to ink jet process of electrostatic ejection type with oil-based ink and capable of preparing a lithographic printing plate which provides a large number of prints having clear image free from background stain and blur of image.

The present invention will be described in more detail with reference to the following examples, but the present invention should not be construed as being limited thereto.

EXAMPLE 1 AND COMPARATIVE EXAMPLES A TO F

Example 1

<Preparation of Lithographic Printing Plate Precursor>

A composition having the following component was placed in a paint shaker (manufactured by Toyo Seiki Co., Ltd.) together with glass beads and dispersed for 60 minutes. Then, the glass beads were removed by filtration to obtain a dispersion.

| | |
|---|---|
| Silica: SILYSIA ® 430 (produced by Fuji-Silysia Chemical Co., Ltd.; average particle diameter: 2,5 $\mu$m) | 26 g |
| 20% Aqueous solution of colloidal silica: SNOWTEX ® C (produced by Nissan Chemical Industries, Ltd.; average particle diameter: 20 mn) | 70 g |
| 10% Aqueous solution of gelatin | 44 g |
| 10% Aqueous solution of trialkoxysilyl-modified polyvinyl alcohol (R-1130 produced by Kuraray Co., Ltd.; modification amount: 0.3 mol %) | 73 g |
| Fluorinated alkylester FC430 (produced by 3M Co.) | 0.24 g |
| Hardening compound (K-1): $CH_2{=}CHSO_2CH_2CONH(CH_2)_3NHCOCH_2SO_2{=}CH{=}CH_2$ | 1.20 g |
| Water | 106 g. |

The dispersion described above was applied to a support (Bekk smoothness on the under layer side: 2,000 (see/10 ml)) of ELP-2X type master (trade name, produced by Fuji Photo Film Co., Ltd.), which is available as an electrophotographic lithographic printing plate precursor for small-scale printing, by means of a wire bar, and then dried at a temperature of 100° C. for 10 minutes to form an image-receiving layer having a coated amount of 8 g/m$^2$. Thus, a lithographic printing-plate precursor was obtained.

Comparative Example A

A lithographic printing plate precursor was prepared in the same manner as in Example 1 except for using only 40 g of SILYSIA® 430 in place of SILYSIA® 430 and SNOWTEX® C in the composition for the image-receiving layer of Example 1.

Comparative Example B

A lithographic printing plate precursor was prepared in the same manner as in Example 1 except for using only 40 g (solid basis) of SNOWTEX® C in place of SILYSIA® 430 and SNOWTEX® C in the composition for the image-receiving layer of Example 1.

Comparative Example C

A lithographic printing plate precursor was prepared in the same manner as in Example 1 except for using 73 g of a 10% aqueous solution of polyvinyl alcohol (PVA 117 produced by Kraray Co., Ltd.) in place of 73 g of a 10% aqueous solution of trialkoxysilyl-modified polyvinyl alcohol R-1130 in the composition for the image-receiving layer of Example 1.

Comparative Example D

A lithographic printing plate precursor was prepared in the same manner as in Example 1 except for using 26 g of silica (SILYSIA® 700 produced by Fuji-Silysia Chemical Co., Ltd.; average particle diameter: 8.0 $\mu$m) and 70 g of a 20% aqueous solution of colloidal silica (SNOWTEX® ZL produced .by Nissan Chemical Industries, Ltd.; average particle diameter: 70 to 100 nm) in place of SILYSIA® 430 and SNOWTEX® C in the composition for the image-receiving layer of Example 1 respectively.

Comparative Example E

A lithographic printing plate precursor was prepared in the same manner as in Example 1 except for changing the ratio of SILYSIA® 430/SNOWTEX® C in the composition for the image-receiving layer to 35/65, that is, using 14 g of SILYSIA® 430 and 130 g of a 20% aqueous solution of SNOWTEX® C.

Comparative Example F

A lithographic printing plate precursor was prepared in the same manner as in Example 1 except for changing the ratio of SILYSIA® 430/SNOWTEX® C in the composition for the image-receiving layer to 75/25, that is, using 30 g of SILYSIA® 430 and 50 g of a 20% aqueous solution of SNOWTEX® C.

The direct drawing type lithographic printing plate precursors thus obtained were examined for their film-forming property (surface smoothness), surface wettability (contact angle with water), film strength and plate-making property.

Further, the printing plates thus obtained by the plate-making were examined for printability (i.e., backgroung stain, press life, etc.) when employed as offset printing plate.

The results obtained are shown in Table A below.

TABLE A

| | Example 1 | Comparative Example A | Comparative Example B | Comparative Example C |
|---|---|---|---|---|
| Surface Smoothness of Image-receiving Layer (sec/10 ml)[1] | 210 | 230 | 600 | 220 |
| Surface Wettability of Image-receiving Layer (degree)[2] | Not more than 5° | Not more than 5° | Not more than 5° | Not more than 5° |
| Film Strength of Image-receiving Layer (%)[3] | 90 | 70 | 25 | 80 |
| Plate-Making Property[4] | | | | |
| Image Quality | Good; No disappearance of fine lines and fine letters, no unevenness in solid image area | Poor; Disappearance of fine lines and fine letters, unevenness in solid image area | Somewhat poor; Spread of fine lines and fine letters | Good |
| Fog in Non-Image Area | Good; Slight toner fog | Good; Slight toner fog | Poor; Severe toner fog | Good |
| Printability[5] | | | | |
| Image Quality | Good; No disappearance of fine lines and fine letters, no unevenness in solid image area | Poor; Disappearance of fine lines and fine letters, unevenness in solid area | Somewhat poor; Spread of fine lines and fine letters | Good |
| Background Stain in Non-Image area | Good; Slight printing ink stain | Somewhat poor; Some ink stain | Poor Severe ink stain | Good |
| Press Life[6] | 8,000 sheets | Disappearance of image area occurred from the beginning of printing | Stain occurred in non-image area from the beginning of printing, image-receiving layer was broken at about 100 sheets from the beginning of printing | 3,500 sheets, disappearance of image area occurred |

| | Comparative Example D | Comparative Example E | Comparative Example F |
|---|---|---|---|
| Surface Smoothness of | 280 | 330 | 120 |

TABLE A-continued

| | | | |
|---|---|---|---|
| Image-receiving Layer (sec/10 ml)[1] | | | |
| Surface Wettability of Image-receiving Layer (degree)[2] | Not more than 5° | Not more than 5° | Not more than 5° |
| Film Strength of Image-receiving Layer (%)[3] | 75 | 85 | 35 |
| Plate-Making Property[4] | | | |
| Image Quality | Somewhat good; Slight disappearance in image area | Good | Somewhat good; Slight disappearance in image area |
| Fog in Non-Image Area | Good; | Poor; Toner fog | Good |
| Printability[5] | | | |
| Image Quality | Somewhat good; | Good | Somewhat good |
| Background Stain in Non-Image area | Good | Poor | Good |
| Press Life[6] | Disappearance of image area occurred from the beginning of printing | Stain occurred in non-image area from the beginning of printing | Disappearance of image area occurred from the beginning of printing, image-receiving layer was broken at about 500 sheets from the beginning of printing |

The properties set forth in Table A were evaluated as follows.

1) Surface Smoothness of Image-receiving Layer

The lithographic printing plate precursor was measured for surface smoothness (sec/10ml)) using a Bekk smoothness tester (produced by Kumagaya Riko K.K.) at an air volume of 10 ml.

2) Surface Wettability of Image-receiving Layer

Two $\mu$l of distilled water was put on the surface of the lithographic printing plate precursor. After 30 seconds, the surface contact angle (degree) was measured using a surface contact meter (CA-D, produced by Kyowa Interface Science Corporation Limited). The smaller the value is, the better is wettability with water and the higher is hydrophilicity.

3) Film Strength of Image-receiving Layer

The surface of the lithographic printing plate precursor was repeatedly rubbed 1,000 times with an emery paper (#1000) under a load of 70 g/cm$^2$ using a surface property testing machine (Haydon-14 Type produced by Shinto Kagaku K.K.). The powder produced by abrasion was then removed. The residual layer rate (%) was calculated from the weight loss of the image-receiving layer to determine the film strength of the image-receiving layer.

4) Plate-Making Property

The lithographic printing plate precursor was subjected to plate-making by a laser beam printer (AMSIS-1200 J Plate Setter) using a dry toner, which is commercially available as AM-Straight Imaging System. The quality of duplicated image on the printing plate precursor thus obtained was visually evaluated through a magnifier of 20 magnifications.

5) Printability

The lithographic printing plate precursor was subjected to plate-making in the same manner as in Item 4) above. The lithographic printing plate thus prepared was then subjected to printing using a full-automatic printing machine (AM-2850 produced by AM Co., Ltd.), a solution prepared by diluting a PS plate processing agent (EU-3 produced by Fuji Photo Film Co., Ltd.) 50 times with distilled water and supplied in a dampening saucer as dampening water, and a black ink for offset printing. The 10th sheet was picked up in the course of printing, and the printed image thereon was visually evaluated for its image quality (background stain and uniformity in solid image area) through a magnifier of 20 magnifications.

6) Press Life

The printing was performed in the same manner as in Item 5) above. The number of prints until background stain or disappearance of image can be visually observed for the first time was determined.

As shown in Table A above, the image-receiving layers provided on the same support in the printing plate precursors of Example 1 and Comparative Examples A and C had almost the same surface smoothness. Comparative Example B using only the colloidal silica as the pigment in the image-receiving layer provided a printing plate precursor having a highly smooth surface.

As a result of evaluating the wettability of the surface of the image-receiving layer using the contact angle with water, all the printing plate precursors exhibited a low contact angle and high hydrophilicity.

As a result of determining the film strength of the image-receiving layer, Example 1 and Comparative Example C exhibited a high value. On the contrary, in Comparative Example A using only the synthetic silica powder as the pigment in the image-receiving layer, the film strength was decreased. The film strength was severely decreased in Comparative Example B using only the colloidal silica as the pigment in the image-receiving layer.

Each of the printing plate precursors was subjected to plate-making practically and the image quality of the image formed on the printing plate precursor was visually observed. The printing plate precursors of Example 1 and Comparative Example C exhibited good image quality. Specifically, the plate-making image formed by transferring dry toner from the laser printer had no disappearance of fine lines and fine letters and had a uniform solid image area. In addition, unevenness of toner transfer was not observed at all. Although a background stain due to the scattering of toner slightly occurred in the non-image area, the background stain was practically acceptable.

On the contrary, in Comparative Example A, disappearance of fine lines and fine letters and unevenness of white spots in the solid image area were observed. Also, in Comparative Example B, the spread of fine lines and fine letters partially occurred and severe fog due to adhesion of toner in the non-image area were observed.

The printing plates thus obtained were evaluated for the printability by means of the image quality and background stain in the non-image area of prints formed therefrom and the press life. As a result, only the printing plate according to the present invention provided 8,000 sheets of good prints-wherein disappearance of fine lines and fine letters and unevenness in solid portion were not observed in the image area and background stain due to adhesion of printing ink was practically acceptable. On the contrary, in case of the printing plate of Comparative Example A, disappearance of fine lines and fine letters and unevenness in solid portion were observed from the beginning of printing. Regarding the printing plate of Comparative Example B, degradation of image quality and background stain occurred from the beginning of printing and break of the image-receiving layer due to the insufficient film strength was observed at about 100 sheets from the beginning of printing. With respect to the printing plate of Comparative Example C, disappearance of the image area occurred at 3,500 sheets from the beginning of printing.

From these results, it can be seen that in case of using the image-receiving layer containing the synthetic silica particles or the ultra-fine colloidal silica particles alone incorporated therein as the inorganic pigment, the film strength thereof is poor. Further, although the contact angle of the surface with water is almost the same as that of the image-receiving layer according to the present invention, its hydrophilicity is insufficient and background stain due to adhesion of printing ink is apt to occur in the practical prints. The image-receiving layer using conventionally known polyvinyl alcohol as the binder resin is inferior in view of the film strength as compared with that of the present invention. In addition, the adhesion of toner image to the image-receiving layer is insufficient and thus, the break of image area occurs after printing of 3,500 sheets.

Moreover, comparing the results of Example 1 with those of Comparative Examples D to F, it is apparent that one or more disadvantages such as insufficient film strength, the occurrence of a stain due to adhesion of printing ink and poor press life are found when synthetic silica particles and ultra-fine colloidal silica particles having a diameter and weight ratio outside the scope of the average particle diameter and weight ratio defined in the present invention are used for the inorganic pigment.

These results indicated that only the printing plate precursor of the present invention can provide a large number of sheets of good prints.

Example 2

<Preparation of Lithographic Printing Plate Precursor>

A composition having the following component was placed in a paint shaker (manufactured by Toyo Seiki Co., Ltd.) together with glass beads and dispersed for 60 minutes. Then, the glass beads were removed by filtration to obtain a dispersion.

| | |
|---|---|
| Silica: SILYSIA ® 310 (produced by Fuji Silysia Chemical Co., Ltd.; average particle diameter: 1.8 $\mu$m) | 28 g |
| 20% Solution of colloidal silica: SNOWTEX ® C | 60 g |
| 10% Aqueous solution of gelatin | 80 g |
| Triethoxysilyl-modified starch: (obtained by modifying starch (PENON Amycol No. 3L, produced by Nichiden Chemical Co., Ltd.) with triethoxychlorosilane (modification amount: 2 mol %)) | 10 g |
| Sodium dodecylbenzenesulfonate | 0.5 g |
| Hardening compound (K-2): $CH_2{=}CHSO_2NH(CH_2)_3NHSO_2{=}CH{=}CH_2$ | 1.5 g |
| Water | 170 g. |

On a support of ELP-2X type master used in Example 1, the above-described dispersion was coated using a wire bar and dried at 100° C. for 10 minutes to form an image-receiving layer having a coated amount of 8 g/m$^2$, thereby preparing a lithographic printing plate precursor.

The surface smoothness of the image-receiving layer was 280 (second/10 ml) in terms of the Bekk smoothness, and the contact angle with water thereof was 0 degree.

A servo plotter (DA8400 produced by Graphtec Corp.) able to write an output from a personal computer was converted so that an ink discharge head as shown in FIG. 3 was mounted on a pen plotter section, and the lithographic printing plate precursor described above was placed on a counter electrode positioned at a distance of 1.5 mm from the ink discharge head. Printing was performed on the lithographic printing plate precursor using Oil-Based Ink (IK-1) described below to conduct plate-making. During the plate-making, an under layer positioned directly under the image-receiving layer was electrically connected with the counter electrode using silver paste.

<Preparation of Oil-Based Ink (IK-I)>

A mixed solution of 10 g of a resin for dispersion stabilization shown below and 290 g of Isopar G was heated to a temperature of 70° C. under nitrogen gas stream with stirring. To the solution was dropwise added a mixture of 65 g of methyl acrylate, 30 g of methyl methacrylate, 5 g of acrylic acid and 1.5 g of 2,2'-azobis(isovaleronitrile) (abbreviated as AIVN) over a period of 60 minutes, followed by reacting for 2 hours. Then, 1.0 g of AIVN was added to the reaction mixture and the temperature of the mixture was adjusted at 75° C., followed by reacting for 2 hours. Then, 0.8 g of 2,2'-azobis(isobutyronitrile) was added to the reaction mixture and the temperature of the mixture was adjusted to 80° C., followed by stirring for 3 hours.

To the reaction mixture was added 5 g of dye (Victoria Blue B), followed by heating at a temperature of 90° C. for 4 hours to color the particles. After cooling the reaction mixture, it was passed through a nylon cloth of 200 mesh. The resulting blue dispersion was a highly monodispersed latex having a polymerization rate of 99.5% and an average particle diameter of 0.38 $\mu$m.

Resin for Dispersion Stabilization

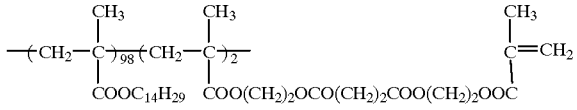

Mw 4 x 10$^4$ (weight ratio)

Sixty grams (solid basis) of the blue dispersion described above and 0.06 g of octadecyl vinyl ether-maleic acid monohexadecylamide copolymer were diluted with one liter of Isopar G, thereby preparing Oil-Based Ink (IK-1).

The image formed by the plate-making was visually observed under an optical microscope of 200 magnifications. As a result, the ink dots formed had true circular shapes and neither distortion nor blur was observed, and fine lines and fine letters were well reproduced.

The printing plate thus obtained was subjected to printing using Oliver 94 Type (produced by Sakurai Seisakusho Co., Ltd.) as a printing machine, a solution prepared by diluting SLM-OD (produced by Mitsubishi Paper Mills, Ltd.) 100 times with water and placed in a dampening saucer as dampening water, and a black ink for offset printing.

Thus, 8,000 sheets of prints free from the disappearance of the image area and the occurrence of background stain in the non-image area were obtained.

Examples 3 to 8

Each lithographic printing plate was prepared in the same manner as in Example 2 except for using 10 g of each of the modified hydrophilic resins shown in Table B below in place of 10 g of triethoxysilyl-modified starch in the image-receiving layer of the lithographic printing plate .precursor of Example 2.

TABLE B

| Example | Modified Hydrophilic Resin |
|---|---|
| 3 | Trialkoxysilyl-modified polyvinyl alcohol (R-2130 produced by Kuraray Co., Ltd.; modification amount: 2.5 mol %) |
| 4 | Tripropoxysilyl-modified PENON JE66 (polypropylene-modified starch (PENON JE66 produced by Nichiden Chemical Co., Ltd.) modified with triethoxychlorosilane (modification amount: 2 mol %)) |
| 5 | Methyldimethoxysilyl-modified polyvinyl alcohol (modification amount: 1 mol %) |
| 6 | Triethoxysilylpropyl-modified gelatin (gelatin modified with 3-isocyanatopropyltriethoxysilane (modification amount: 1.5 mol %)) |
| 7 | Tributoxysilyl-modified PENON F3 (succinic acid-modified starch (PENON F3 produced by Nichiden Chemical Co., Ltd.) modified with tributoxychlorosilane (modification amount: 3 mol %)) |
| 8 | Triethoxysilylpropyl-modified cellulose (cellulose modified with 3-thiocyanatopropyl-triethoxysilane (modification amount: 2 mol %)) |

The surface smoothness of the image-receiving layer of each lithographic printing plate precursor was in a range of 250 to 300 (second/10 ml) in terms of the Bekk smoothness, and the contact angle with water thereof was 0 degree.

Each printing plate precursor was subjected to plate-making and printing in the same manner as in Example 2. each of the printing plate provided more than 8,000 sheets as good as those obtained in Example 2 for image quality and background stain in the non-image area.

Examples 9 to 13

Each lithographic printing plate precursor was prepared in the same manner as in Example 1 except for using each of the hardening compounds shown in Table C below in place of Hardening compound (K-1) in the image-receiving layer of the lithographic printing plate precursor of Example 1. The surface smoothness of the image-receiving layer of each lithographic printing plate precursor was in a range of 200 to 250 (second/10 ml) in terms of the Bekk smoothness, and the contact angle with water thereof was 0 degree.

TABLE C

| Example | Hardening Compound | Amount |
|---|---|---|
| 9 | (K-4) $CH{=}CH{-}SO_2NH(CH_2)_3NHSO_2CH{=}CH_2$ | 1.2 g |
| 10 | (K-5) 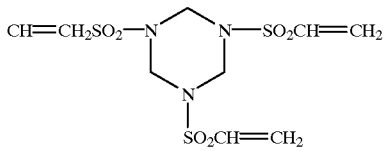 | 0.3 g |
| 11 | (K-6) 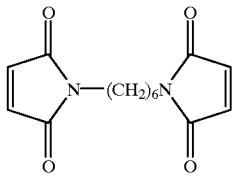 | 1.0 g |
| 12 | (K-7) $[Cl(CH_2)_2SO_2CH_2CH_2]_2C{=}O$ | 1.3 g |
| 13 | (K-8) 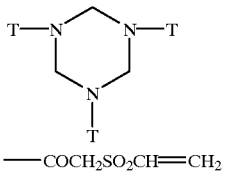 $T = {-}COCH_2SO_2CH{=}CH_2$ | 0.3 g |

Each of the printing plate precursors obtained was subjected to plate-making and printing in the same manner as in Example 1. More than 8,000 sheets of prints as good as those obtained in Example 1 were obtained.

Example 14

<Preparation of Lithographic Printing Plate Precursor>

A composition having the following component was placed in a paint shaker (manufactured by Toyo Seiki Co., Ltd.) together with glass beads and dispersed for 60 minutes. Then, the glass beads were removed by filtration to obtain a dispersion.

| | |
|---|---|
| Silica: SILYSIA ® 310 | 28 g |
| 20% Solution of collodial silica: SNOWTEX ® C | 60 g |
| Clay | 2 g |
| 10% Aqueous solution of gelatin | 40 g |
| 10% Aqueous solution of trialkoxysilyl-modified polyvinyl alcohol (R-1130) | 70 g |
| Sodium dodecylbenzenesulfonate | 0.5 g |
| Hardening compound (K-2): $CH_2{=}CHSO_2NH(CH_2)_3NHSO_2CH{=}CH_2$ | 1.5 g |
| Water | 110 g. |

On a support of ELP-2X type master used in Example 1, the above-described dispersion was coated using a wire bar and dried at 100° C. for 10 minutes to form an image-receiving layer having a coated amount of 8 g/m$^2$, thereby preparing a lithographic printing plate precursor.

The surface smoothness of the image-receiving layer was 220 (second/10 ml) in terms of the Bekk smoothness, and the contact angle with water thereof was 0 degree.

The printing plate precursor obtained was subjected to plate-making and printing in the same manner as in Example 2. More than 10,000 sheets of prints having clear image free from background stain in the non-image area were obtained.

Example 15

The lithographic printing plate precursor prepared in Example 1 was subjected to plate-making using a heat-sensitive printer (MP-120OPro produced by Murashi Co., Ltd.). The image formed on the printing plate precursor was good without disappearance of fine lines and fine letters. Using the resulting printing plate, printing was conducted in the same manner as in Example 1. More than 6,000 sheets having clear image free from background stain in the non-image area were obtained.

Examples 16 to 17

Each lithographic printing plate precursor was prepared in the same manner as in Example 1 except for using alumina sol (520 produced by Nissan Chemical Industries, Ltd.; average particle diameter: 20 nm)(Example 16) or titania sol (STS02 produced by Ishihara Sangyo Kaisha, Ltd.; average particle diameter: 5 to 10 nm) (Example 17) in place of colloidal silica in the image-receiving layer of the lithographic printing plate precursor of Example 1.

Each of the printing plate precursors was subjected to plate-making and printing in the same manner as in Example 1. Each of the resulting printing plate provided 8,000 sheets of prints as good as those obtained in Example 1 wherein disappearance of image was not observed and stain in the non-image area was practically acceptable.

Example 18

<Preparation of Lithographic Printing Plate Precursor>

A composition having the following component was placed in a paint shaker (manufactured by Toyo Seiki Co., Ltd.) together with glass beads and dispersed for 60 minutes. Then, the glass beads were removed by filtration to obtain a dispersion.

| | |
|---|---|
| Silica: SILYSIA ® | 28 g |
| 20% Solution of colloidal silica: SNOWTEX ® 20 (produced by Nissan Chemical Industries, Ltd.; average particle diameter: 20 nm) | 60 g |
| 10% Aqueous solution of triethoxysilyl-modified starch: (obtained by modifying starch (PENON Amycol No. 3L, produced by Nichiden Chemical Co., Ltd.) with triethoxychlorosilane (modification amount: 15 mol %)) | 115 g |
| Water | 100 g. |

On a support of ELP-2X type master used in Example 1, the above-described dispersion was coated using a wire bar and dried at 100° C. for 10 minutes to form an image-receiving layer having a coated amount of 8 g/m$^2$, thereby preparing a lithographic printing plate precursor.

The surface smoothness of the image-receiving layer was 250 (second/10 ml) in terms of the Bekk smoothness, and the contact angle with water thereof was 0 degree.

The lithographic printing plate precursor was subjected to plate-making in the same manner as in Example 2. The image formed on the lithographic printing plate precursor was visually observed under an optical microscope of 200 magnifications. As a result, the ink dots formed had true circular shapes and neither distortion nor blur was observed, and fine lines and fine letters were well reproduced.

The printing plate thus obtained was subjected to printing in the same manner as in Example 2. Thus, 7,000 sheets of prints free from the disappearance of the image area and the occurrence of background stain in the non-image area were obtained.

While the invention has been described in detail and with reference to specific embodiments thereof, it will be apparent to one skilled in the art that various changes and modifications can be made therein without departing from the spirit and scope thereof.

What is claimed is:

1. A direct drawing lithographic printing plate precursor comprising a water-resistant support having provided thereon an image-receiving layer, the image-receiving layer being formed from a dispersion comprising:

an inorganic pigment comprising silica particles having an average particle diameter of from 1 to 6 $\mu$m and ultra-fine particles of inorganic pigment having an average particle diameter of from 5 to 50 nm, at a weight ratio thereof of from 40:60 to 70:30; and a hydrophilic binder resin comprising at least one modified hydrophilic binder resin which is modified with a silyl functional group represented by the following formula (I):

$$—Si(R)_n(OX)_{3-n} \quad (I)$$

wherein R represents a hydrogen atom or a hydrocarbon group having from 1 to 12 carbon atoms; X represents an aliphatic group having from 1 to 12 carbon atoms; and n represents 0, 1 or 2.

2. The direct drawing lithographic printing plate precursor as claimed in claim 1, wherein the dispersion further comprises gelatin and a gelatin hardening compound.

3. The direct drawing lithographic printing plate precursor as claimed in claim 2, wherein the gelatin hardening compound is a compound having in its molecule at least two double bond groups represented by the following formula (II):

$$CH_2{=}CH—W— \quad (II)$$

wherein W represents —$OSO_2$—, —$SO_2$—, —$CONR^1$— or —$SO_2NR^1$— (wherein $R^1$ represents a hydrogen atom or an aliphatic group having from 1 to 8 carbon atoms).

4. The direct drawing lithographic printing plate precursor as claimed in claim 3, wherein $R^1$ is a hydrogen atom or an alkyl group having from 1 to 6 carbon atoms which may be substituted.

5. The direct drawing lithographic printing plate precursor as claimed in claim 1, wherein the ultra-fine particles of inorganic pigment having an average particle diameter of from 5 to 50 nm comprise at least one member selected from colloidal silica, titania sol and alumina sol.

6. The direct drawing lithographic printing plate precursor as claimed in claim 1, wherein R in formula (1) represents the hydrocarbon group and is selected from an alkyl group having from 1 to 12 carbon atoms which may be substituted, an aklenyl group having from 3 to 12 carbon atoms which may be substituted, an araklyl group having from 7 to 12 carbon atoms which may be substituted, an alycyclic group having from 5 to 8 carbon atoms which may be substituted, and an aromatic group having from 6 to 12 carbon atoms which may be substituted.

7. The direct drawing lithographic printing plate precursor as claimed in claim 1, wherein the aliphatic group represented by X in formula (I) is selected from an alkyl group having from 1 to 8 carbon atoms which may be substituted, an aklenyl group having from 3 to 8 carbon atoms which may be substituted, an araklyl group having from 7 to 12 carbon atoms which may be substituted, and an alycyclic group having from 5 to 8 carbon atoms which may be substituted.

8. The direct drawing lithographic printing plate precursor as claimed in claim 1, wherein the aliphatic group represented by X in formula (I) is an alkyl group having from 1 to 4 carbon atoms which may be substituted.

9. The direct drawing lithographic printing plate precursor as claimed in claim 1, wherein the modified hydrophilic binder resin contains the silyl functional group represented by formula (I) in an amount of from 0.01 to 50% by mole in terms of a component repeating unit which contains the silyl functional group.

10. The direct drawing lithographic printing plate precursor as claimed in claim 1, wherein the image-receiving layer has a weight ratio of the inorganic pigment to the hydrophilic binder resin of from 85:15 to 50:50.

11. The direct drawing lithographic printing plate precursor as claimed in claim 1, wherein the image-receiving layer has a surface smoothness of not less than 30 (sec/10 ml) in terms of Bekk smoothness.

12. The direct drawing lithographic printing plate precursor as claimed in claim 1, wherein the image-receiving layer has an average surface center roughness (SRa) defined by ISO-468 in the range of from 1.3 to 3.5 $\mu$m and an average wavelength (Sea) of not more than 50 $\mu$m.

13. The direct drawing lithographic printing plate precursor as claimed in claim 1, wherein the water-resistant support has a surface which contacts with the image-receiving layer and which has a smoothness of at least 300 (sec/10 ml) in terms of Bekk smoothness.

14. A method of preparing a lithographic printing plate comprising:

electrostatically transferring an electrophotographically formed toner image onto a direct drawing lithographic printing plate precursor to form an image thereon, wherein the direct drawing lithographic printing plate is as claimed in claim 1.

15. The method of preparing a lithographic printing plate as claimed in claim 14, wherein the water-resistant support of the lithographic printing plate precursor has a volume specific electric resistance of from $10^4$ to $10^{13}$ Ω·cm.

16. A method of preparing a lithographic printing plate comprising:

ejecting an oil-based ink with an electrostatic ink jet recording system onto a direct drawing lithographic printing plate precursor to form an image thereon, wherein the direct drawing lithographic printing plate precursor is as claimed in claim 1.

17. The method of preparing a lithographic printing plate as claimed in claim 16, wherein the water-resistant support of the lithographic printing plate precursor has a volume specific electric resistance of not more than $10^{10}$ Ω·cm.

18. The method of preparing a lithographic printing plate as claimed in claim 16, wherein the oil-based ink is a dispersion comprising:

a nonaqueous solvent, as a dispersion medium, having an electric resistance of $10^9$ Ω·cm or more and a dielectric constant of 3.5 or below; and hydrophobic resin particles, which are solid at least at a temperature of 15 to 35° C., dispersed in the nonaqueous solvent.

* * * * *